US005465791A

United States Patent [19]

Loitherstein

[11] Patent Number: 5,465,791

[45] Date of Patent: Nov. 14, 1995

[54] RESILIENT SPIDER FOR WELL INSTALLATION

[76] Inventor: Joel S. Loitherstein, 76 Warren Rd., Ashland, Mass. 01722

[21] Appl. No.: 291,375

[22] Filed: Aug. 16, 1994

[51] Int. Cl.[6] ..... E21B 43/04

[52] U.S. Cl. ..... 166/278; 166/51; 166/202

[58] Field of Search ..... 166/380, 51, 278, 166/202, 241.6, 241.4, 382, 177, 241.1

[56] References Cited

U.S. PATENT DOCUMENTS

| | | | |
|---|---|---|---|
| 602,547 | 1/1898 | Titus . | |
| 2,781,100 | 2/1957 | Pyle et al. | 166/173 |
| 3,039,534 | 6/1962 | Koop | 166/202 X |
| 3,231,021 | 1/1966 | Greene, Jr. | 166/117 |
| 4,066,125 | 1/1978 | Bassani | 166/202 |
| 4,133,398 | 1/1979 | Still | 175/171 |
| 4,287,948 | 9/1981 | Haggard | 166/170 |
| 4,306,620 | 12/1981 | Fronius | 166/241.6 |
| 5,247,990 | 9/1993 | Sudol et al. | 166/241.4 X |

FOREIGN PATENT DOCUMENTS

| | | | |
|---|---|---|---|
| 1694867 | 11/1991 | U.S.S.R. | 166/51 |
| 9216717 | 10/1992 | WIPO | 166/51 |

*Primary Examiner*—Hoang C. Dang

*Attorney, Agent, or Firm*—Hamilton, Brook, Smith & Reynolds

[57] ABSTRACT

A resilient spider is circumferentially mounted on a well section and has extension arms which, in a flexed condition, allow a desired vertical movement of the well relative to an auger in a borehole, and in an unflexed condition, may be used to secure the well in circumdisposed relationship to the lower end of the auger.

6 Claims, 5 Drawing Sheets

RESILIENT SPIDER FOR WELL INSTALLATION

BACKGROUND OF THE INVENTION

This invention relates to the installation of wells. During well installation, the securing of well tubing or pipe in a borehole while the borehole is backfilled with sand and cement is often hampered by the upward buoyant force of groundwater located in the borehole. A need exists for a device for securing a well pipe in a borehole in the presence of a buoyant force due to groundwater.

SUMMARY OF THE INVENTION

According to the present invention, a spider is provided which, in a flexed condition, allows a desired vertical movement of a well pipe relative to an auger to occur, and in an unflexed condition, may be used to secure the well pipe in circumdisposed relationship to the lower end of the auger. The spider includes a circular planar base which is frictionally circumferentially mounted on a well pipe section. The spider also includes a plurality of resilient arms which are integral to the base and which normally extend radially outwardly therefrom. The resilient arms are of sufficient length such that in their unflexed position, they overlap the rim of the lower end of the auger, holding the well pipe against the auger while sand or other material is backfilled over the arms. The resilient arms of the spider may also be flexed upwardly relative to the base. The diameter of the spider in the flexed condition is less than the inner diameter of the auger. Thus, the well pipe with the spider mounted may be lowered vertically through the auger when the spider is in the flexed condition.

The above and other features of the invention including various novel details of construction will now be more particularly described with reference to the accompanying drawings and pointed out in the claims. It will be understood that the particular spider embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1B:
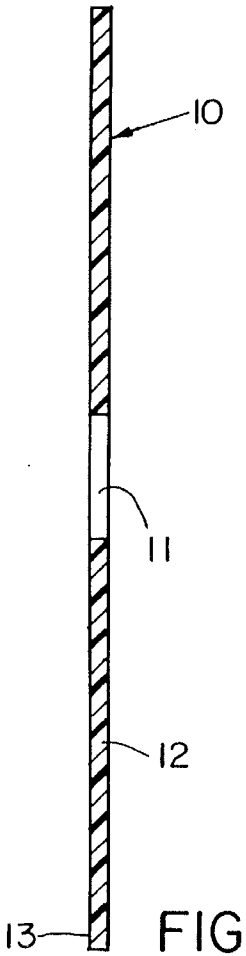
FIG. 1B is a sectional side view of the spider of the present invention taken along line I—I.
Figure 1A:
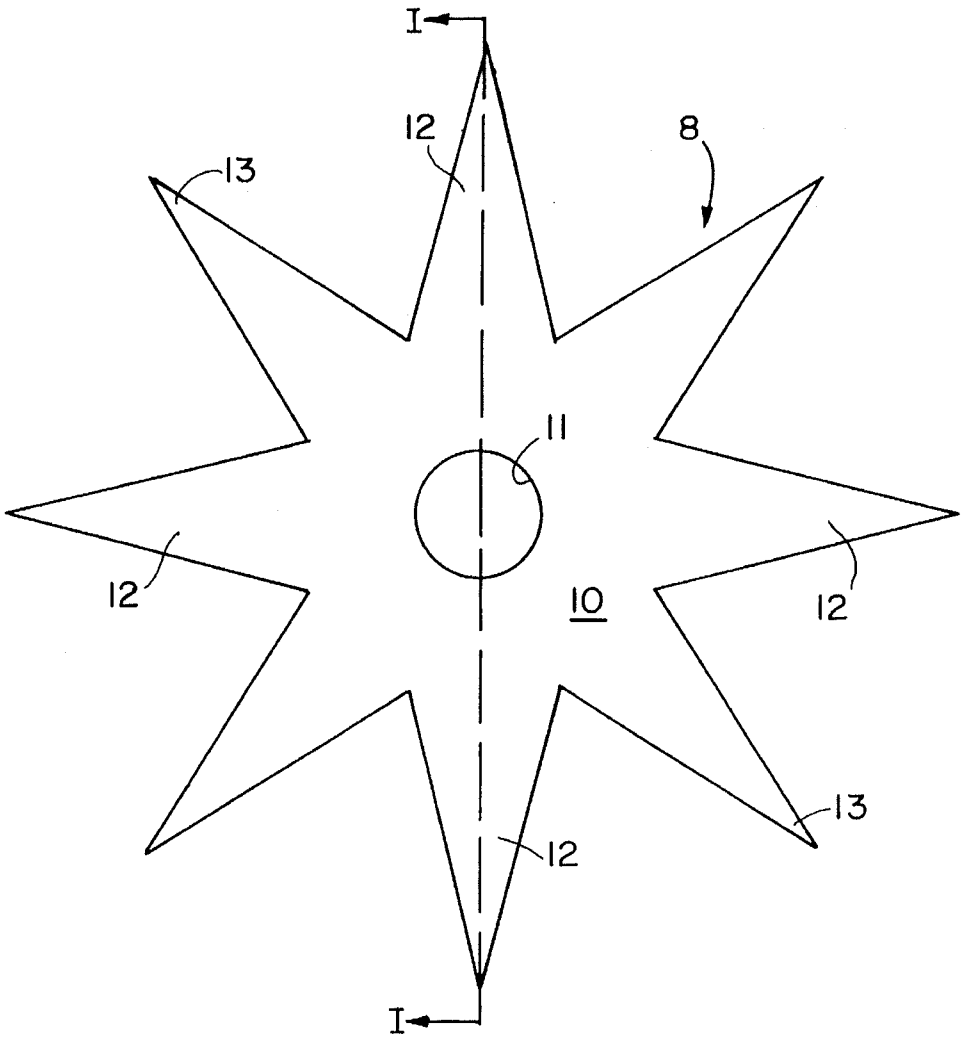
FIG. 1A is a plan view of the spider of the present invention.
Figure 6:
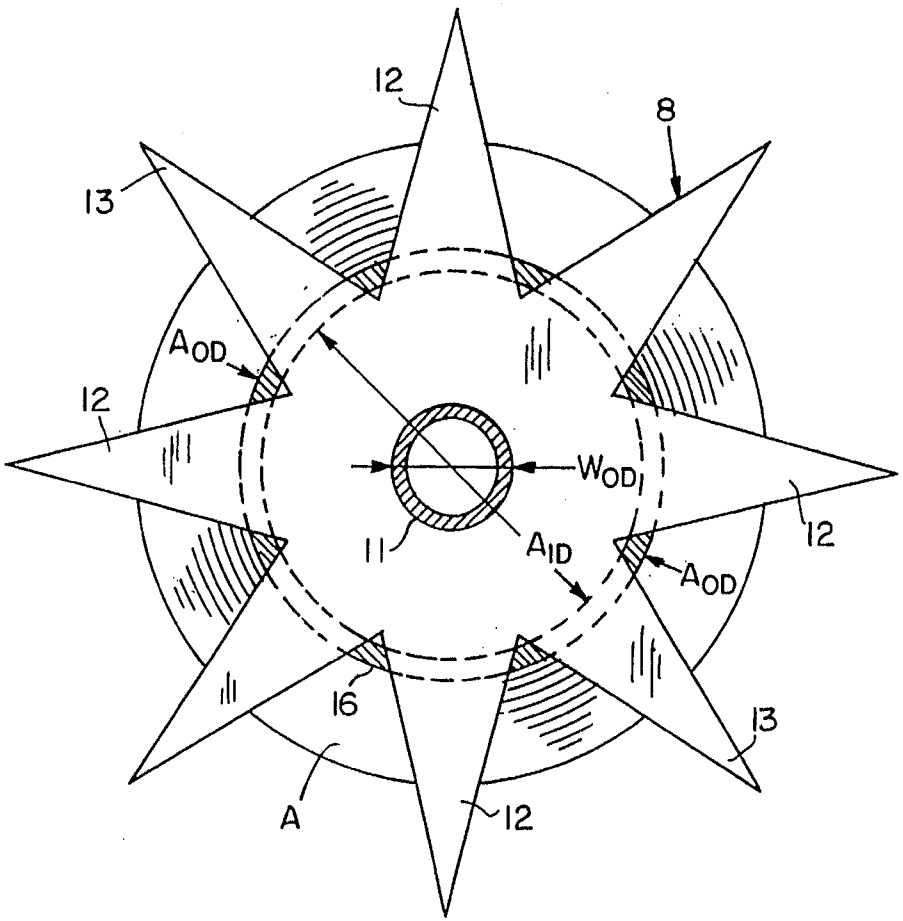
FIG. 6 is a bottom plan view, partly in cross-section, taken on the line VI—VI of FIG. 4, showing the spider in the unflexed position when the well pipe is moved below the lower end of the auger.

Reference is now made to FIGS. 1–6 which illustrate the preferred embodiment of the present invention. A flexible spider 8 has an inner circular planar base portion 10 and an outer peripheral portion in the form of flexible extension arms 12 which are integral to the base portion 10 (FIG. 1). The base portion 10 provides a lateral opening 11 for receiving a well pipe section 18. Although the spider 8 as presently illustrated optionally has eight extension arms, equally spaced from each other, a greater or lesser number of arms may be used. While the resilient spider arms 12 are optionally shown as being triangular in shape, other shapes, such as rectangular or oblong may also be used. The spider 8 is preferably made from a resilient plastic material such as polyethylene, of approximately ⅛ inch thickness, and is of molded construction. Each spider arm 12 terminates in an actuating portion 13.

The lateral opening 11 of the base portion 10 is adapted to fit snugly about a well pipe section 18 (FIG. 2) of a cylindrical well pipe W having an outer diameter $W_{OD}$. A well cap 19 is formed at the lower end of the well pipe section to prevent sand from entering into the well. When the spider 8 is being used, a cylindrical auger A is circumdisposed about the well pipe section 18 in substantially concentric relationship thereto. In a flexed condition, the spider arms 12 are flexed upwardly so that the well pipe W can move vertically through the auger A. In an unflexed condition, the spider 8 may be used to secure the well pipe W in circumdisposed relationship to the lower end of the auger A such that the unflexed spider arms 12 overlap a rim 16 of the auger A, holding the well pipe W against the auger while sand or other material is backfilled over the arms.

The present invention is particularly suited for the installation of monitoring wells. While the well pipe W may typically have an outer diameter $W_{OD}$ of about 2½ inches, the cylindrical auger A may typically have an inner diameter $A_{ID}$ of about six inches and an outer diameter $A_{OD}$ of about ten inches.

Figure 2:
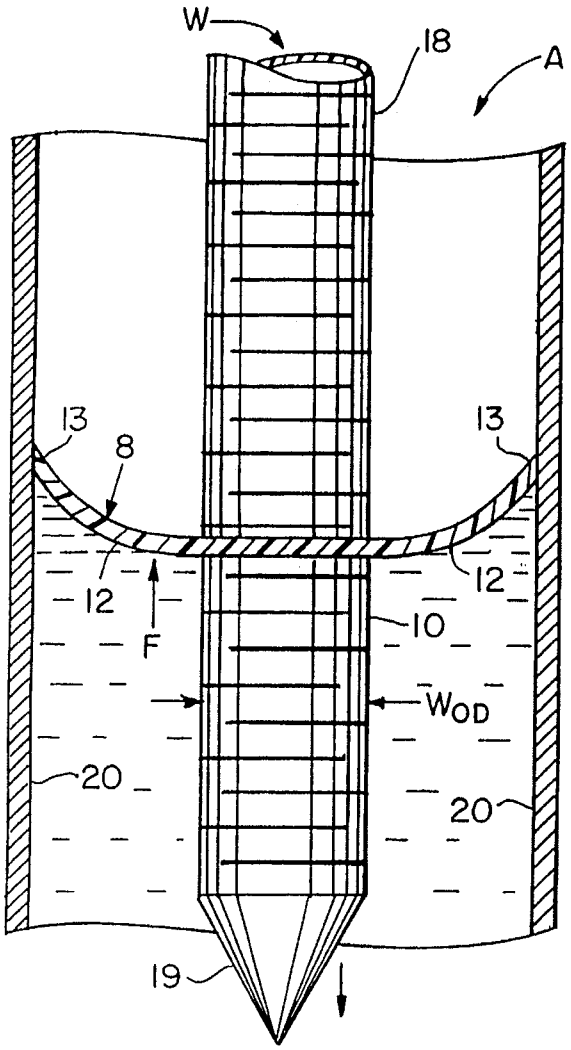
FIG. 2 is a cross-sectional elevation view of the spider 8 when the well pipe W is disposed between the inner walls 20 of the auger.
Figure 3:
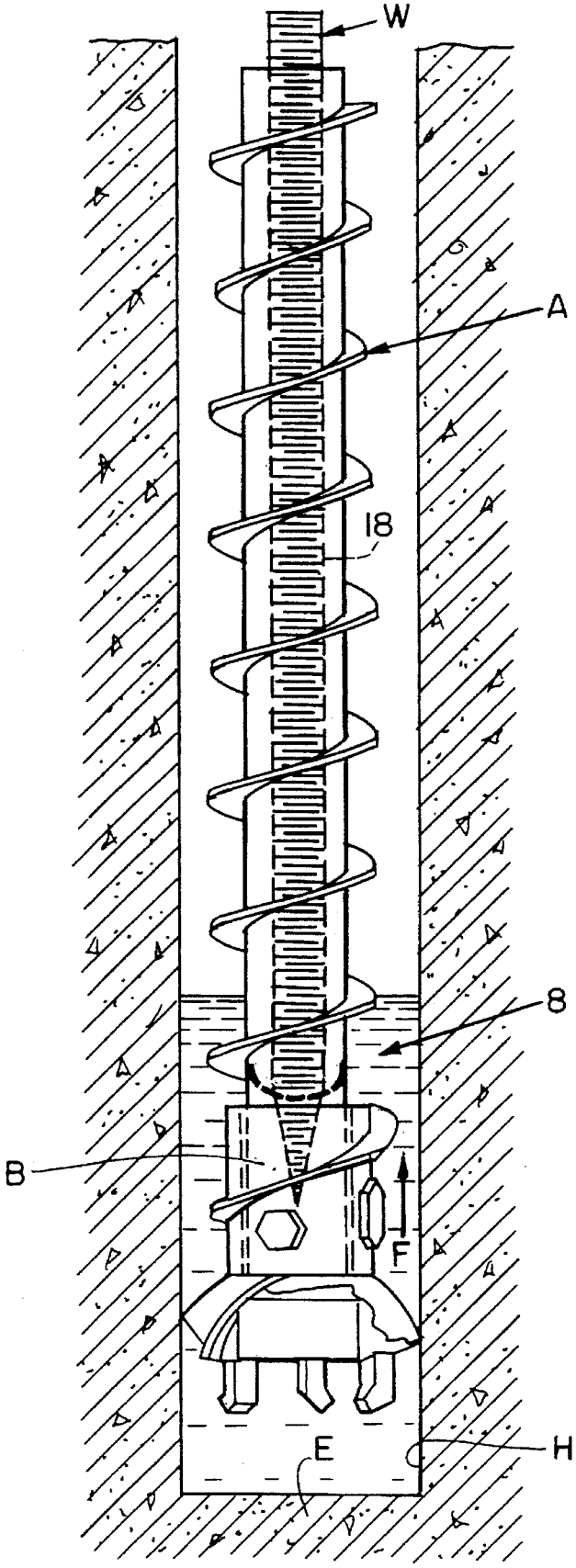
FIG. 3 is an elevation view, partly in cross-section, of the spider mounted on a well pipe positioned within an auger when the well pipe is being moved vertically relative to the auger.

The operation of the spider 8 will now be described in detail. In a well installation, the auger A having a bit B is used to form a borehole H in stratum E (FIG. 3). The well pipe W with the spider 8 attached is placed into the upper end of the auger and pushed downward through the auger. FIGS. 2 and 3 illustrate the spider in the flexed condition as the well pipe W is passed through the inner walls 20 of the auger. The actuating portion 13 of each resilient spider arm 12 frictionally contacts the inner walls 20 of the auger A, and the vertical movement of the well pipe causes the spider arms 12 to flex upwardly. The diameter of the spider in the flexed condition is less than the inner diameter $A_{ID}$ of the auger. The frictional contact of the resilient spider arms 12 with the auger walls 20 opposes an upward buoyant force F due to groundwater located in the borehole.

Figure 4:
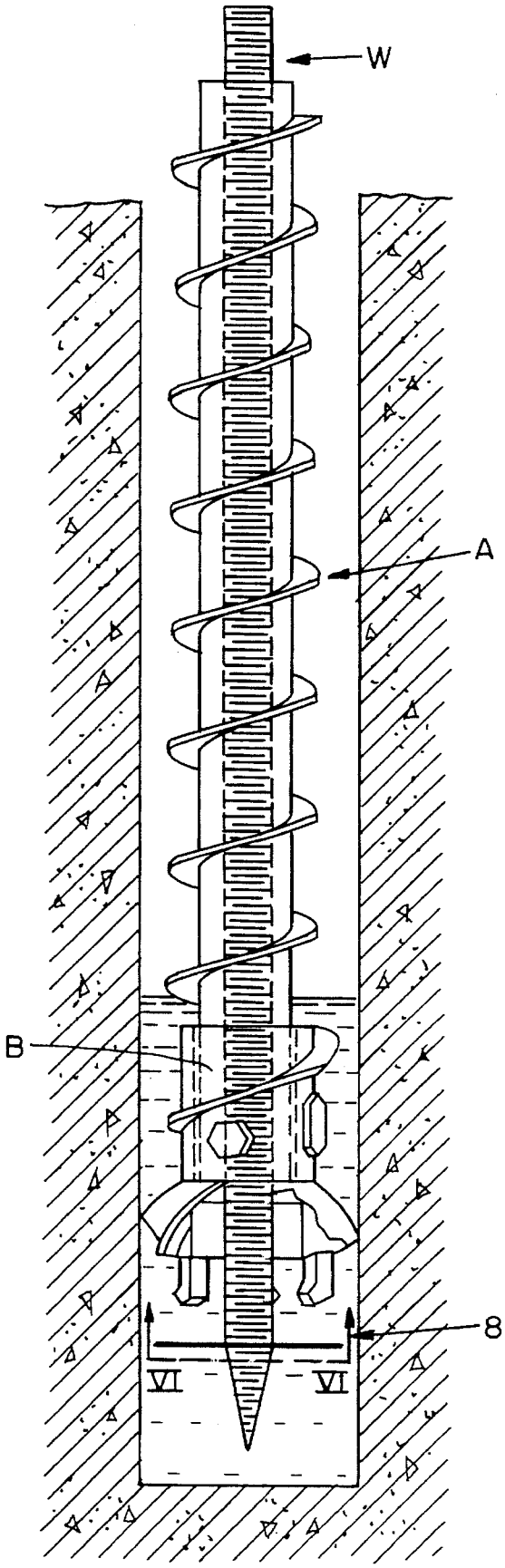
FIG. 4 is a view similar to FIG. 3 but showing the spider arms in the unflexed position when the well pipe is moved below the lower end of the auger.
Figure 5:
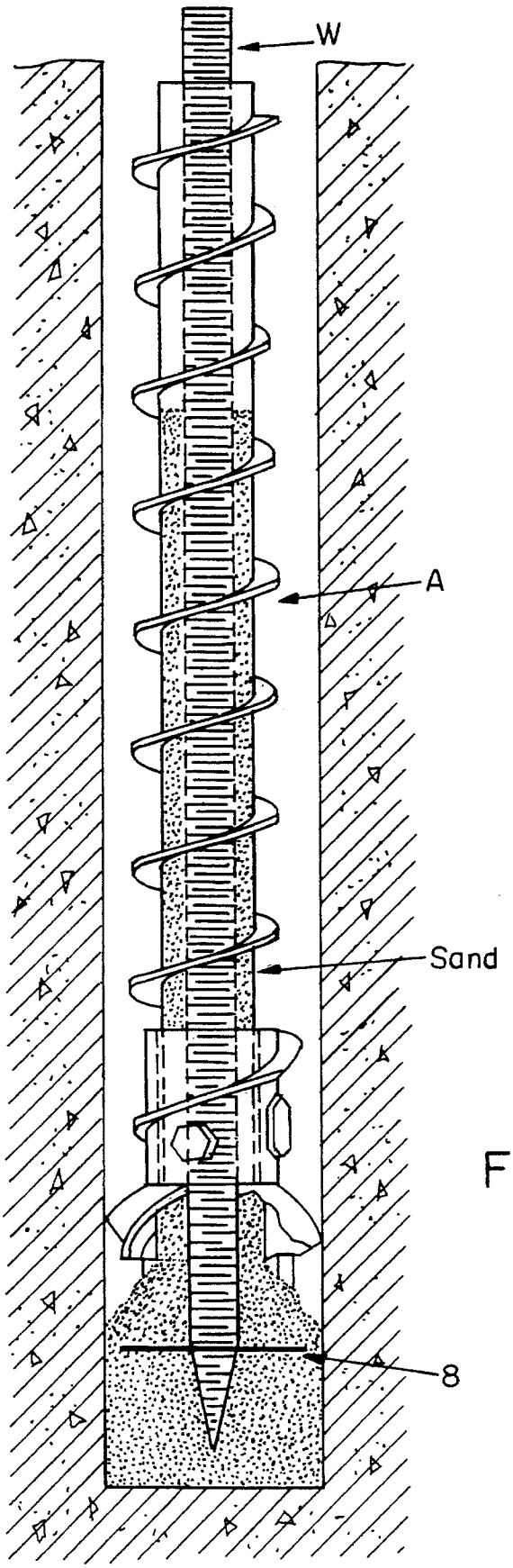
FIG. 5 is a view similar to FIG. 4 showing sand backfill added to hold the well pipe in position.

When the well pipe W is pushed to a point where the spider 8 is positioned below the lower end of the auger A, the resilient arms 12 return to their unflexed condition (FIG. 4). The resilient arms 12 are of sufficient length such that in their unflexed condition, they overlap the auger rim 16 as shown in the sectional view of FIG. 6. With the spider 8 positioned below the lower end of the auger A, the buoyant force F of the groundwater causes the unflexed spider arms 12 to contact the auger rim 16, thereby securing the well pipe W in circumdisposition thereto. With the spider 8 securing the well pipe in circumdisposed relationship to the auger, and after the auger is retracted slightly, sand backfill may be introduced into the hollow auger so as to rest upon the upper horizontal surface of the spider arms 12, thereby further securing the well pipe W in the borehole (FIG. 5).

EQUIVALENTS

Those skilled in the art will know, or be able to ascertain using no more than routine experimentation, many equivalents to the specific embodiments of the invention described herein. These and all other equivalents are intended to be encompassed by the following claims.

What is claimed is:

1. In a monitoring well installation wherein a borehole is made by an auger, the auger having an inner cylindrical wall and an outer rim, apparatus comprising:

a well pipe section; and a spider comprising:

a circular planar base having an opening frictionally mounted circumferentially on an outer wall of the well pipe section; and a plurality of resilient arms extending radially outwardly from the base which in one operating condition frictionally engage the inner wall of the auger and in another operating condition overlap the rim of the auger.

2. The apparatus of claim 1 wherein the spider is formed of resilient plastic.

3. The apparatus of claim 1 wherein the arms are triangular in shape.

4. A method of installing a well pipe in a borehole made by an auger, the auger having inner walls and an outer rim, comprising the steps of:

mounting a spider circumferentially on a lower section of the well pipe, wherein the spider comprises a circular planar base having an opening for such mounting and a plurality of resilient arms integral to the base and extending radially outwardly therefrom which in one operating condition are adapted for frictionally engaging the inner walls of the auger and opposing an upward buoyant force of groundwater located in the borehole, and in another operating condition are adapted for overlapping the rim of the lower end of the auger and being circumdisposed thereto;

pushing the well pipe with the spider mounted thereupon downward through the auger located in a borehole such that the inner walls of the auger are frictionally engaged by the spider arms; and positioning the spider mounted on the well pipe below the lower end of the auger such that the well pipe is supported against the rim of the lower end of the auger by the upward buoyant force of the groundwater located in the borehole.

5. The method of claim 4 wherein the spider is formed of resilient plastic.

6. The method of claim 4 wherein the arms are triangular in shape.

* * * * *